US006267612B1

(12) United States Patent
Arcykiewicz et al.

(10) Patent No.: US 6,267,612 B1
(45) Date of Patent: Jul. 31, 2001

(54) ADAPTIVE COUPLING MECHANISM

(75) Inventors: Robert R. Arcykiewicz, Bartlett, IL (US); Walter J. Olender, Shelby Township, MI (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 09/456,534

(22) Filed: Dec. 8, 1999

(51) Int. Cl.[7] ..... H01R 4/38
(52) U.S. Cl. ..... 439/253; 439/256
(58) Field of Search ..... 439/253, 254, 439/255, 256, 257

(56) References Cited

U.S. PATENT DOCUMENTS

| | | |
|---|---|---|
| 1,721,365 | 7/1929 | Zwetsch . |
| 3,173,473 | 3/1965 | Loveland . |
| 3,430,184 | 2/1969 | Acord . |
| 3,452,316 | 6/1969 | Panek et al. . |
| 4,134,634 | 1/1979 | Baur et al. . |
| 4,208,082 | 6/1980 | Davies et al. . |
| 4,632,480 | 12/1986 | Carpenter . |
| 4,941,846 | 7/1990 | Guimond et al. . |
| 5,380,214 | 1/1995 | Ortega, Jr. . |

*Primary Examiner*—Gary F. Paumen
*Assistant Examiner*—Ross Gushi
(74) *Attorney, Agent, or Firm*—Blank Rome Comisky & McCauley, LLP

(57) ABSTRACT

The internally threaded coupling ring or nut of a conventional rotational coupling system is replaced with a multi-tined locking ring that traverses the threads in an axial direction and locks onto the external threads of the mating half. The tines are positioned such that the forces are evenly distributed around the connector periphery and an anti-decoupling sleeve is extended over the tines and arranged such that, when the sleeve is in a first position, tangs extending inwardly from the tines are prevented from escaping the threads of the externally threaded mating half, and such that the sleeve may be pulled in an axial direction to permit the tines to more easily clear the threads and thereby facilitate decoupling.

11 Claims, 3 Drawing Sheets

ADAPTIVE COUPLING MECHANISM

BACKGROUND OF THE INVENTION

1. Field of the Invention

This invention relates to an adaptive coupling mechanism, and in particular to a coupling mechanism arranged to replace a conventional threaded coupling ring or nut. The adaptive coupling mechanism of the invention enables linear push-pull quick coupling and decoupling of a first connector half to and from an externally threaded mating connector half. In addition, the adaptive coupling mechanism of the invention includes anti-decoupling features that prevent the connector halves from being unintentionally decoupled as a result of shocks or vibrations.

The coupler of the invention may be used in electrical, hydraulic, or pneumatic coupling systems, and in a preferred embodiment, includes a multi-tined locking ring that, following initial axial insertion, engages the mating threads of the externally threaded connector half with a series of locking tines. A coupling sleeve is biased in a first direction to a locking position in order to prevent unintentional decoupling, and is arranged to be pulled in a second direction opposite the first direction to permit axial disengagement of the locking tines from the threads of the threaded connector half and thereby permit axial decoupling. The tines are arranged to permit some rotation in order to prevent breakage due to improper operation.

2. Description of Related Art

Conventional threaded coupling systems are composed of two coupling halves. The first coupling half has mounted on it a rotatable coupling ring or nut having an internally threaded diameter, and the second coupling half is externally threaded to accept and rotatably mate with the internally threaded coupling ring or nut of the first coupling half.

By way of example, some electrical connectors employ a coupling system that is threaded at a pitch of 20 threads per inch, and are mated together by rotation of the internally threaded coupling ring onto the externally threaded connector half. Typically, such coupling systems require from a half to a full dozen turns to bring the connectors to a full mate.

In order to avoid the need to rotate the internally threaded coupling ring onto the externally threaded connector half, a number of connector designs exist which replace the coupling ring with push-pull type "quick connect/disconnect" mechanisms or structures. For the most part, these designs are in the form of systems that completely replace both the internally and externally threaded portions of the rotatable coupler with a linear coupling mechanism that may consist of detented tines, complementary structures arranged to form an interference fit, and more complicated latching structures.

In existing systems, it is generally impractical to completely replace all male and female couplers. As a result, if the rotational coupling system is to be replaced by a push-pull system, some type of adapter is needed. An example of such an adapter was proposed many years ago in the related context of lighting systems, to permit quick connection and disconnection of light bulbs from their sockets. Examples of this concept are described in U.S. Pat. Nos. 1,721,365, 3,173,473, and 5,380,214, each of which discloses an adapter ring for a light socket that permits axial push-pull engagement and disengagement of tines from conventional externally threaded light bulbs.

A problem with the light socket designs, which makes them inapplicable to many electrical, pneumatic, or hydraulic coupler applications, is that the adapters disclosed in these patents do not include any provision for preventing unintentional release of the threaded portion of the light bulb from its mating socket. This is a serious disadvantage in, for example, military or aerospace applications where the adapter is subject to shocks and vibrations that could cause the threads to disengage or pull away from the tines, leading to risks of electrical shock in the case of electrical power connectors, leakage in the case of hydraulic connection systems, or failure of the equipment being coupled.

An improvement over the push-pull designs used in the context of lighting systems, which provides for push-pull engagement of a coupler mechanism with a threaded connector half and also provides for positive anti-vibration or decoupling prevention, is the coupling mechanism disclosed in U.S. Pat. No. 4,941,846. This coupling mechanism uses a cam arranged to cause internally threaded coupling jaws to engage the external threads of a mating connector half as the coupling mechanism is pushed onto the connector half, and a coupling sleeve that extends over the jaws to prevent their disengagement from the mating coupler half until the sleeve is pulled back.

A disadvantage of the coupling mechanism disclosed in U.S. Pat. No. 4,941,846 is that, while the use of a cam and internally threaded jaws permits axial engagement and disengagement of the coupling mechanism to and from the externally threaded connector half, the arrangement is relatively costly in comparison with alternative conventional rotational or push-pull type coupler systems, and is difficult to adapt to most existing connector systems.

A final group of prior coupling mechanisms involving adapters fitted onto externally threaded connector halves is disclosed in U.S. Pat. Nos. 3,430,184, 3,452,316, 4,208,082, and 4,632,480. The coupling mechanism in this group share structures with those of the push-pull light socket adaptors and the coupling mechanism of U.S. Pat. No. 4,941,846, but are used in the context of quick-release umbilical chord connectors for missiles, bombs, and the like, and thus are designed only to facilitate axial disengagement rather than both axial coupling and decoupling.

To date, the inventors are aware of no other prior coupling mechanism that offers the combination, provided by the invention, of a coupling mechanism that can mate and lock a first connector half to a second externally threaded connector half using a purely linear motion, that also permits linear disengagement of the mating connector halves as well as positive decoupling prevention, and yet that can economically be provided either as an integrated connector/coupler half or as an adaptor for an existing connector or coupler half.

SUMMARY OF THE INVENTION

It is accordingly an objective of the invention to provide a coupling mechanism that enables axial coupling and decoupling of a first connector half to and from an externally threaded second connector half with positive decoupling prevention, and yet that is simple and reliable in construction and operation.

It is also an objective of the invention to provide a simple and reliable coupling mechanism that can be pushed over the threads of a conventional externally threaded connector to lock onto the external threads of the connector without rotational motion, that includes a feature for positively preventing unintentional decoupling, and that can also be decoupled using a purely linear motion.

It is a yet another objective of the invention to provide a mechanism for permitting connection of two coupler halves with a reduced mating and unmating time and that provides anti-vibration and shock coupling forces, through the distribution of locking forces around the periphery of the mated halves via a plurality of tines locked against their respective thread profiles.

These objectives are achieved by providing a coupling mechanism designed to replace a conventional threaded coupling ring with a one-piece coupling ring that, following initial axial insertion, engages the mating threads of a conventional externally threaded connector half with a series of locking tines.

In a preferred embodiment of the invention, the internally threaded coupling ring or nut of the conventional rotational coupling system is replaced with a multi-tined locking ring that traverses the threads in an axial direction and locks onto the external threads of the mating half. The tines are positioned such that the forces are evenly distributed around the connector periphery and an anti-decoupling sleeve is extended over the tines and arranged such that, when the sleeve is in a first position, tangs extending inwardly from the tines are prevented from escaping the threads of the externally threaded mating half, and such that the sleeve may be pulled in an axial direction to permit the tines to more easily clear the threads and thereby facilitate decoupling.

To mate a coupling system with the included invention, in say perhaps an electrical connector application, the mating keys of the first connector half initially need to be aligned, as is necessary in any other connector system, after which the first connector half is pushed onto the conventional externally threaded mating connector half with an axial force. To un-mate the connector halves, the coupling sleeve is simply pulled back and the first connector half is pulled off of the mating connector half. Pulling back the coupling sleeve disengages the locking tines from the external threads and frees the mated halves.

The coupling mechanism of the invention may be used with a variety of electrical, pneumatic, or hydraulic connector systems. An example of a connector to which the invention may beneficially be applied is the MIL-C-5015 family of electrical connectors. This line of connectors is frequently used in industrial applications. The invention can be adapted to this family of threaded connectors and sold as a retrofit plug to be used in applications that already exist or incorporated easily into current production. The invention allows for the upgrading of threaded connectors to a quick-disconnect type without the concern of backward compatibility since the externally threaded receptacle need not be changed.

DETAILED DESCRIPTION OF THE PREFERRED EMBODIMENTS

Figure 1:
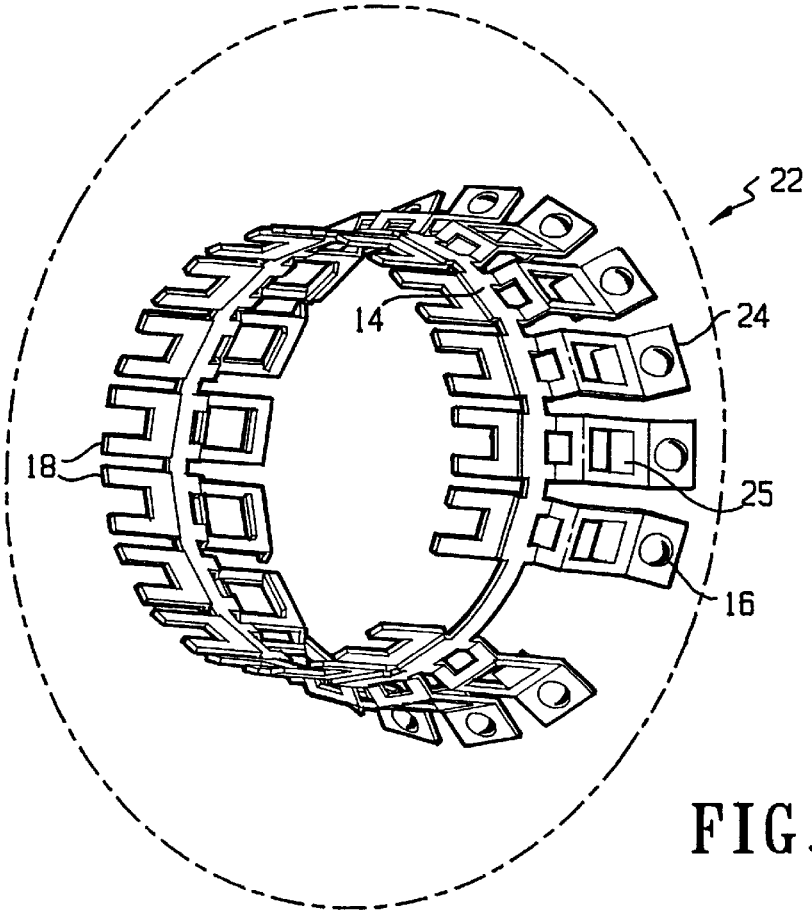
FIG. 1 is an isometric view of a locking ring constructed in accordance with the principles of a preferred embodiment of the invention.
Figure 2:
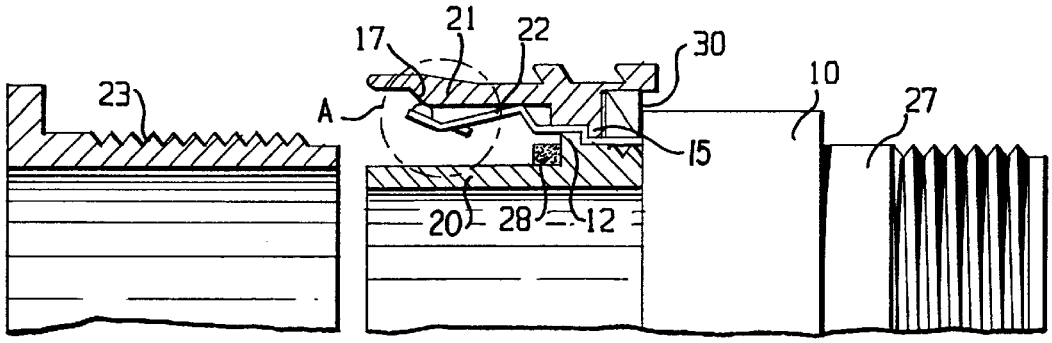
FIG. 2 is a cross-sectional view of a pair of coupler halves constructed in accordance with the principles of the invention, in a neutral, unmated condition.
Figure 2A:
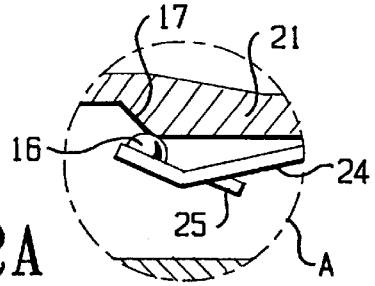
FIG. 2A is an enlarged view of a portion of the locking ring of FIG. 1, in the coupler position shown in FIG. 2.
Figure 3:
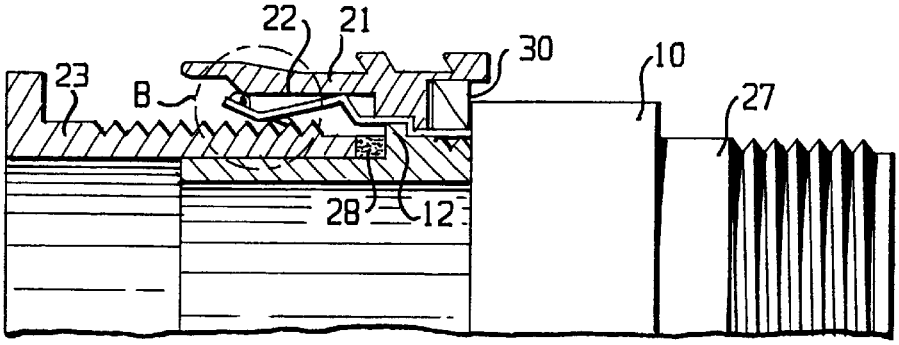
FIG. 3 is a cross-sectional view of the coupler halves of FIG. 2 in a mated condition.
Figure 4:
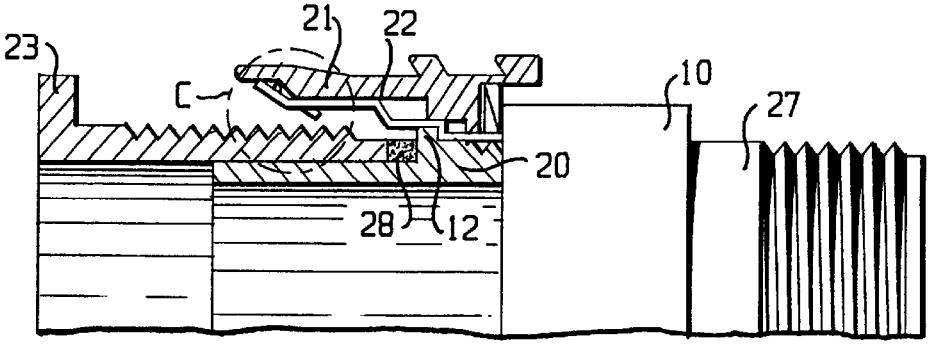
FIG. 4 is a cross-sectional view of the coupler halves of FIG. 2 in a mated condition, but with the coupling sleeve pulled back, releasing the tines.
Figure 4A:
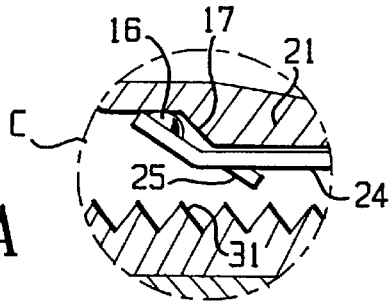
FIG. 4A is an enlarged view of a portion of the locking ring of FIG. 1, in the coupler position shown in FIG. 4.

As shown in FIGS. 2–4, the coupling assembly includes traditional threaded connector halves 20 and 23. In lieu of a traditional, rotatable, threaded coupling ring on connector half 20, a replacement coupling sleeve 21 is designed to cooperate, according to the principles of a preferred embodiment of the invention, with locking ring 22 illustrated in detail in FIGS. 1 and 5, such that it operates in the manner to be described below.

Locking ring 22 is roll-formed to a diameter that enables it to be captured between the parent connector half 20 and the coupling sleeve 21, and includes a plurality of tines 24. The coupling sleeve 21 is held in the forward-most position by a wave spring 30 and followed by a fastening element, in this case a transition adapter 27, which holds all aforementioned components in place. Those skilled in the art will appreciate that the configuration of the adapter 27 will depend on the type of connector on which it is to be mounted, or which it is designed to replace, and which in the illustrated example is a MIL-C-5015 type electrical connector. In this example, which is not to be construed as limiting, the adapter 27 includes an internally threaded section 10 arranged to be threaded onto the parent connector half 20, while connector half 20 includes a protruding flange 12 for capturing the coupling sleeve 21 and wave spring 30, the spacing between the installed adapter 27 and flange 12 permitting limited axial movement of the sleeve 21 relative to the main body of connector half 20. Locking ring 22 includes slotted sections 18 through which extend projections (not shown) of the connector half 20 in order to prevent relative rotation of the locking ring 22.

The coupling sleeve 21 in its neutral position, is situated away from the user, i.e., to the left as illustrated in FIGS. 2–4, towards the mating coupler half 23. The inner diameter of coupling sleeve 21 pushes the tines 24 of the locking ring 22 towards the center of the connector half 20. The locking ring 22 includes a section 14 held captive between the protruding flange 12 of connector half 20 and an inwardly extending portion 15 of the coupling sleeve 21. In front of protruding flange 12 of coupler half 20 resides resilient element 28. This element 28 minimizes residual linear play between the coupled halves that may exist due to manufacturing variations or design tolerances in the tines 24, and may be arranged to provide sealing.

To mate with the standard threaded part of connector half 23 without the need for the mating part 20 to be threaded requires an element that can adapt to the thread shape. For this purpose, the locking ring 22 is comprised of multiple tines 24 and tangs 25, sets of which deliver the desired action. The tangs 25, best illustrated in FIGS. 1, 2A, 3A, 3B, and 4A are small tabs that are attached to and extend in a direction opposite that of the tines 24. They have direct interaction with the thread and are used to lock the coupler halves together by flexing of the tines 24.

Figure 3A:
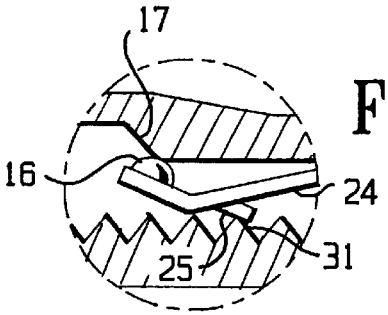
FIGS. 3A and 3B are enlarged views of portions of the locking ring of FIG. 1, in the coupler position shown in FIG. 3.
Figure 3B:
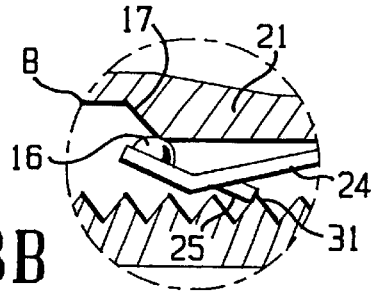

As illustrated in FIGS. 3A and 3B, when the first connector half 20 is pushed forward onto the second coupler half 23, tines 24 bend as needed to allow tangs 25 to ride over the thread's crest 31. This is repeated over each thread crest 31 until the coupler halves have reached a final mated position shown in FIG. 3. The final mated position is ideally reached when the coupler halves are fully mated and a predetermined number of tang 25 ends are at an angle perpendicular to the thread face or slightly greater than perpendicular, towards the thread root of their respective threads 31, as shown in FIG. 3B.

While the tines 24 are sized and positioned to achieve this result, but only a certain percentage of the total tangs 25 will actually end up in the ideal mating position. The remaining percentage of tangs 25 fall within ½ "stagger distance" of the ideal location. Some tangs may rest on or before a thread crest, as shown in FIG. 3A. The holding power of the combination of tines 24 and tangs 25 provides a sufficient force to hold the connector halves together. Should an above average, "unintentional decoupling force" be applied to the mated connectors, however, perhaps by a person pulling on the cable, a greater percentage of tangs engage the thread to oppose this force.

Flexibility of the tine is critical to its operation and is carefully achieved through proper design of the tine body, i.e. material, thickness, and shape. The tines 24 are arranged in such a manner that allows the greatest positive lock-up between tang 25 and thread 31. The tangs 25, and hence coupler half 20, operate uni-directionally during mating, in that once the tangs 25 have engaged their respective threads 31, they restrict all backward movement. Thus, when the connector is pushed to its fully mated condition, the connector halves are locked together.

Figure 5:
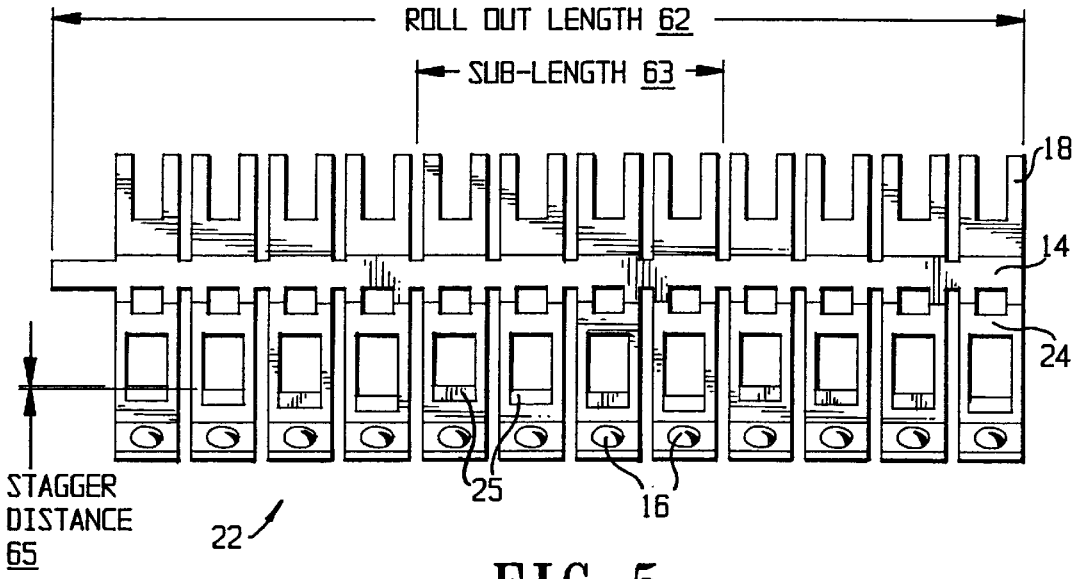
FIG. 5 is a rolled-out view of the locking ring of FIG. 1.
Figure 6:
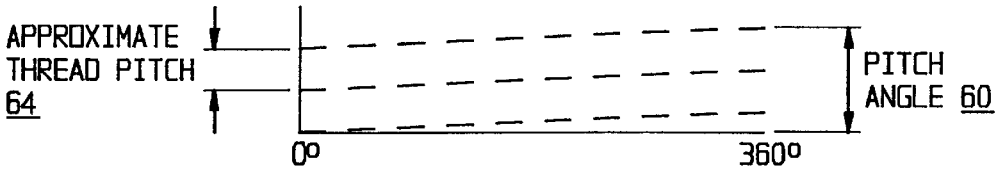
FIG. 6 is a diagram showing a rolled-out thread of an externally threaded connector half to be coupled to the coupling mechanism of FIGS. 1–5.
Figure 7:
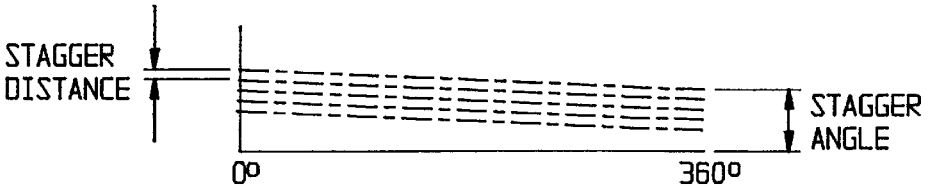
FIG. 7 is a diagram illustrating the principles according to which the stagger angle for the tines of the locking ring of FIGS. 1 and 5 are selected.
Figure 8:
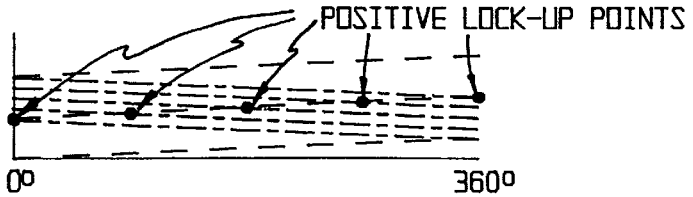
FIG. 8 is a diagram of the respective rolled out threads and staggered tines of FIGS. 6 and 7, shown superpositioned to illustrate the manner in which forces are distributed in a coupled position.

Placement of the tangs onto the tines with respect to the locking ring, one tang per tine, is such that the mating force is evenly distributed around the periphery of the mated connectors and greater retentive forces result between the mated coupler halves. The placement exhibits a "staggered pattern" and has been designed as follows: Although the locking ring 22 is roll-formed into a final, circular configuration, for design and discussion purposes it is illustrated in FIG. 5 as being rolled out flat, as it would exist in early manufacturing stages. Prime factors for tang 25 placement are the thread pitch 64 and pitch angle 60 of the externally threaded mating connector half 23. These factors were used for rudimentary design. Once designed about a particular pitch 64, the tine 24 and tang 25 setup will work for a range of pitches both lower and higher than the designed-to pitch 64. By "rolling out" one full 360-degree section of thread 31, as shown in FIGS. 6–8, and measuring the angle of a projected line representing the thread crest, with respect to the connector face, the pitch angle 60 is calculated. The "negative" of this angle is the basis for achieving optimal retentive forces in the mated condition. It is used later to position the tangs 25 along each tine 24 and is referred to as the stagger-angle 61, illustrated in FIG. 7.

The total unfolded length 62 of the locking rings is based on the outside circumference of protruding flange 12 of connector half 20 on which the locking ring 22 resides. As the flange diameter and hence the coupler size is changed, the length and number of tines can be modified to suit, enabling the use of the same base locking ring with the addition or subtraction of a few tines. This length is divided into equal sub-lengths 63. Inside each sub-length 63, a number of tines 24 are placed such that the number meets design criteria, i.e., geometric constraints and optimal strength. The tines 24 are equally spaced inside the sub-length 63. The pitch 64 of the thread 31, divided by the number of tines 24 that through design can be fit in a sub-length 63, is referred to as the stagger-distance 65. Stagger distance 65 is the dimensional deviation between one tang and the next, in the axial direction.

The stagger-distance, in combination with the stagger angle, determines the number of tines that result in a "positive" lock-up of a tang and a respective thread. If the tines were not staggered, there would exist a lower number of engaged tines, resulting in reduced overall effectiveness of the connection. The tangs are placed, one tang per tine, onto the tines and shifted from tine to tine, by the stagger distance. This tine and tang placement is repeated through out the "unfolded" locking ring length in each sub-length, across the locking ring.

Since moving parts are involved in the operation of the coupling system, special considerations were taken during design of the preferred embodiment of the invention. One of the design challenges was to minimize forces at the sliding interface between the coupling sleeve 21 which releases the locking tines 24 and the tines themselves. To solve this challenge, a dimple 16 situated at the end of each tine 24 and arranged to engage an inclined ramp surface 17 of coupling sleeve 21 was chosen as the operative feature leading to smooth interaction between sliding surfaces of the tine and coupling sleeve 2). It is however possible to use different shapes to achieve the same results. In a traditional threaded coupling system, the user would rotate the internally threaded coupling ring to disengage the coupling halves. This consideration must be taken into account and can be addressed by, for example, constraining the coupling sleeve 21 so that it will move in a linear direction or, alternatively, by designing the coupling mechanism accordingly.

Choosing the tine end-geometry to be a dimple or some similar acting feature, such as a crowned lance, allows both linear and rotational motion at the interface of the coupling sleeve and tine. Without rotational considerations, the locking tines would be susceptible to twisting which would result in undue stresses and undoubtedly result in deformation. Without the linear considerations, a less than optimal geometry of the tine end, would hinder tine release, and hence cause substandard operation. Phrased differently, the dimple 26 provides a critical yet preventive design measure that protects the mechanism from the actions of an un-trained user of such a coupling system, who attempts to decouple the connector in a rotational manner as is standard in a threaded coupling system. This signals the user that application of something other than a rotary motion is needed to couple, but more importantly decouple, the connector.

Although the tangs 25 provide a preferred direction of movement of tines 24 relative to the threads of connector half 23, so long as the tines 24 are permitted to flex in a radially outward direction, the tangs 25 can be relatively easily disengaged from the threads by pulling on the connector half 20 in an axial direction. In order to permit radially outward flexing of the tines 24, the sleeve 21 is pulled in the decoupling direction so that it moves axially relative to the connector half 20 against the bias provided by wave spring 30 until it can no longer move relative to the connector half 20, at which time further pulling on the sleeve 21 causing the tangs 25 to be pulled over the threads, decoupling the connector halves.

Although a preferred embodiment of the invention has been described with sufficient particularity to enable a person skilled in the art to make and use the invention without undue experimentation, it will be appreciated that numerous other variations and modifications of the illustrated embodiments, in addition to those already noted above, may be made by those skilled in the art. Each of these variations and modifications, including those not specifically mentioned herein, is intended to be included within the scope of the invention, and thus the description of the invention and the illustrations thereof are not to be taken as limiting, but rather it is intended that the invention should be defined solely by the appended claims.

What is claimed is:

1. A coupling mechanism for enabling push-pull engagement of a first connector half with an externally threaded second connector half, comprising:

a coupling sleeve arranged to be fitted onto the first connector half;

a generally cylindrical locking ring including a plurality of axially extending resilient tines including tangs extending inwardly from the tines and arranged to engage threads of the second connector half when the first and second connector halves are coupled together, wherein said coupling sleeve is biased to a first position in which the sleeve extends over ends of said resilient tines, wherein the tines are configured so as to bend when pushed in the axial direction and ride over the threads of the second connector half when the first and second connector halves are being coupled together but are prevented by the coupling sleeve from flexing radially outwardly by an amount sufficient to permit unintended decoupling of the first and second connector halves, and wherein the sleeve is arranged to be pulled in an axial decoupling direction to permit the tines to clear the threads to permit decoupling of the connector halves.

2. A coupling mechanism as claimed in claim 1, wherein said tines are distributed around a circumference of said locking ring.

3. A coupling mechanism as claimed in claim 1, further comprising raised protrusion extending from ends of said tines in a radially outward direction to engage an inside surface of said coupling sleeve.

4. A coupling mechanism as claimed in claim 1, wherein said coupling sleeve is biased relative to said first connector half by a wave spring extending around said first connector half.

5. A coupling mechanism as claimed in claim 1, wherein said coupling sleeve is captured between a flange projecting from the first connector half and an internally threaded adapter that has been threaded onto external threads of the first connector half.

6. A coupling mechanism as claimed in claim 1, further comprising a resilient member positioned inside said locking ring to minimize residual play between coupled connector halves and provide sealing.

7. A coupling mechanism as claimed in claim 1, wherein said connector halves are halves of an electrical connector.

8. A coupling mechanism as claimed in claim 1, wherein each resilient tine includes a single tang and a series of resilient tines having the position of their tangs staggered so that optimal retention can be achieved when the first and second connector halves are mated.

9. A coupling mechanism as claimed in claim 1, wherein the tines have raised protrusions on their ends to prevent rotational stress in the coupling mechanism.

10. A coupling mechanism as claimed in claim 1, wherein said tines extend in a first axial direction, said tines further including tangs extending inwardly at an acute angle relative to the tines in a second axial direction.

11. A coupling mechanism as claimed in claim 10, wherein said tangs are axially positioned at different distances from distal ends of said tines so as to engage different threads of the externally threaded connector and therefore optimize a locking force.

* * * * *

UNITED STATES PATENT AND TRADEMARK OFFICE

CERTIFICATE OF CORRECTION

PATENT NO. : 6,267,612 B1
DATED : July 31, 2001
INVENTOR(S) : Robert R. Arcykiewicz et al.

It is certified that error appears in the above-identified patent and that said Letters Patent is hereby corrected as shown below:

Column 6,
Line 30, change "2)" to -- 21 --.

Column 7,
Line 29, after "wherein" insert -- when said coupling sleeve is in said first position --;
Line 38, after "direction" insert -- to a second position --.

Signed and Sealed this

Twenty-ninth Day of June, 2004

JON W. DUDAS
*Acting Director of the United States Patent and Trademark Office*